US008627636B2

(12) United States Patent
Yang et al.

(10) Patent No.: US 8,627,636 B2
(45) Date of Patent: Jan. 14, 2014

(54) METHOD OF CONSTRUCTING LIQUEFIED GAS STORAGE TANK ON LAND

(75) Inventors: Young Myung Yang, Gyeonggi-do (KR); Ihn Soo Yoon, Incheon-si (KR); Heung Seok Seo, Gyeonggi-do (KR); Young Kyun Kim, Seoul-si (KR)

(73) Assignee: Korea Gas Corporation, Seongnam-si (KR)

( * ) Notice: Subject to any disclaimer, the term of this patent is extended or adjusted under 35 U.S.C. 154(b) by 563 days.

(21) Appl. No.: 12/627,969

(22) Filed: Nov. 30, 2009

(65) Prior Publication Data

US 2011/0099940 A1 May 5, 2011

(30) Foreign Application Priority Data

Nov. 5, 2009 (KR) ..... 10-2009-0106530

(51) Int. Cl.

| | |
|---|---|
| ***E04B 1/04*** | (2006.01) |
| ***E04B 1/16*** | (2006.01) |
| ***E04H 7/18*** | (2006.01) |
| ***E04B 2/40*** | (2006.01) |
| ***E04B 2/68*** | (2006.01) |

(52) U.S. Cl.

CPC .. *E04H 7/18* (2013.01); *E04B 2/40* (2013.01); *E04B 2/68* (2013.01)

USPC ..... 52/745.01; 52/245; 52/383; 52/565; 52/569; 52/745.03

(58) Field of Classification Search

USPC ..... 52/223.4, 223.5, 245, 249, 382, 383, 52/562, 656, 569, 745.01, 745.03, 742.14

See application file for complete search history.

(56) References Cited

U.S. PATENT DOCUMENTS

| | | | | | |
|---|---|---|---|---|---|
| 1,050,130 | A * | 1/1913 | Harvey | 52/583.1 |
| 3,300,943 | A * | 1/1967 | Owens | 52/745.11 |
| 4,006,570 | A * | 2/1977 | Stolz | 52/432 |
| 4,180,951 | A * | 1/1980 | Francioni | 52/100 |
| 5,038,540 | A * | 8/1991 | Krautz | 52/245 |
| 6,401,417 | B1 * | 6/2002 | Leblang | 52/481.1 |
| 7,555,872 | B1 * | 7/2009 | Beach | 52/745.1 |
| 2011/0099930 | A1 | 5/2011 | Yang et al. | |

FOREIGN PATENT DOCUMENTS

| | | | |
|---|---|---|---|
| CN | 2270083 | Y | 9/2012 |
| FR | 2539792 | A1 | 7/1984 |
| FR | 2658228 | A1 | 8/1991 |
| GB | 718606 | A | 11/1954 |
| GB | 2124743 | A | 2/1984 |
| JP | 56120900 | A | 9/1981 |
| JP | 56120900 | A1 | 9/1981 |
| JP | 2000336969 | A | 12/2000 |
| JP | 2004106884 | A | 4/2004 |
| KR | 100430862 | B1 | 4/2004 |

* cited by examiner

*Primary Examiner* — William Gilbert
(74) *Attorney, Agent, or Firm* — Seed IP Law Group PLLC

(57) ABSTRACT

The present disclosure relates to a method of constructing a liquefied gas storage tank on land, which enables rapid and easy construction of walls of a cylindrical storage tank by stacking a plurality of pre-produced unit-wall structures to be stacked or superposed with respect to one another. The method includes: producing unit-wall structures made of concrete and each having iron rods arranged lengthwise and breadthwise therein, stacking the unit-wall structures in a cylindrical arrangement, and connecting the unit-wall structures adjacent and in longitudinal and lateral directions with respect to each other to form a wall of the storage tank.

10 Claims, 4 Drawing Sheets

METHOD OF CONSTRUCTING LIQUEFIED GAS STORAGE TANK ON LAND

CROSS REFERENCE TO RELATED APPLICATION

This application claims priority from and the benefit of Korean Patent Application No. 10-2009-0106530, filed on Nov. 5, 2009, which is hereby incorporated by reference for all purposes as if fully set forth herein.

BACKGROUND

1. Technical Field

The present disclosure relates to a method of constructing a liquefied gas storage tank on land and, more particularly, to a method of constructing a liquefied gas storage tank on land, which enables rapid and easy construction of a cylindrical wall of the storage tank by stacking a plurality of pre-produced unit-wall structures to be stacked or superposed with respect to one another.

2. Description of the Related Art

Generally, a liquefied gas storage tank on land has a substantially cylindrical flat bottom and is used to store liquefied gas for fuels, such as liquefied natural gas (LNG), liquefied petroleum gas, and the like, and other liquefied gases such as liquefied oxygen, liquefied nitrogen, and the like. One example of such a cylindrical liquefied gas storage tank is disclosed in Japanese Patent Laid-open Publication No. Sho 56-120900.

FIG. 1 shows one example of a conventional full-containment type liquefied gas storage tank on land. Referring to FIG. 1, the liquefied gas storage tank includes a cylindrical tank body 3 formed through concrete casting on a foundation 1 and having an approximately dome-shaped cover.

The tank body 3, which is made of concrete, is provided therein with a heat insulating bottom 4 and a heat insulating wall 5, and a vapor barrier 2 is interposed between the tank body 3 and the heat insulating bottom 4 and between the tank body 3 and the heat insulating wall 5. Inside the heat insulating bottom 4 and the heat insulating wall 5, a container 6 is located to contain a cryogenic liquefied gas in a sealed state.

Since the container 6 directly contacts the liquefied gas, it may be made of a low-temperature carbon material or the like, which is capable of enduring cryogenic conditions.

Such a conventional liquefied gas storage tank is generally constructed to have the cylindrical tank body 3 by performing foundation work and repeating a process of pouring concrete into a mould on the foundation 1 to produce one wall having a predetermined height and a process of re-pouring the concrete into the mould to produce another wall of a predetermined height on the one wall after the one wall is completely hardened to have predetermined strength. Accordingly, the conventional liquefied gas storage tank has a problem in that considerable time is consumed for construction thereof.

BRIEF SUMMARY

According to one embodiment, a method of constructing a liquefied gas storage tank on land enables rapid and easy construction of a cylindrical wall of the storage tank by stacking a plurality of pre-produced unit-wall structures to be stacked or superposed with respect to one another.

In accordance with one aspect, a method of constructing a liquefied gas storage tank on land includes: producing unit-wall structures made of concrete and each having iron rods arranged lengthwise and breadthwise therein; stacking the unit-wall structures in a cylindrical arrangement; and connecting the unit-wall structures adjacent and in vertical and lateral directions to each other to form a wall of the storage tank.

Each of the unit-wall structures may have grooves on upper, lower, left and right surfaces thereof, and the stacking of the unit-wall structures may include interposing a positioning block between the unit-wall structures to be fitted into the groove to allow the unit-wall structures to be located in place when the unit-wall structures are stacked.

In one embodiment, the iron rods may be arranged to protrude from upper, lower, left and right surfaces of the unit-wall structures, and the connecting of the unit-wall structures may include connecting the protruded iron rods of each of the unit-wall structures to those of other unit-wall structures adjacent thereto in the vertical and lateral directions.

In one aspect, the iron rods may be connected to each other through an iron rod plate having a plurality of through-holes.

In one aspect, the connecting of the unit-wall structures may further include connecting front sides of the unit-wall structures to each other while connecting rear sides of the unit-wall structures to each other, after connecting the iron rods.

In one aspect, the front sides of the unit-wall structures may be connected to each other through a front side connecting plate and the rear sides of the unit-wall structures may be connected to each other through a rear side connecting plate.

In one aspect, the method may further include casting the concrete into a space between the unit-wall structures to integrate the unit-wall structures with each other after connecting the iron rods.

In one aspect, each of the unit-wall structures may be provided at one side thereof with a sealing layer, and the connecting of the unit-wall structures may include connecting the sealing layers of the respective unit-wall structures to each other.

In one aspect, the method may further include performing foundation work to form a foundation before stacking the unit-wall structures; and placing a cover to complete a tank body of the storage tank after connecting the unit-wall structures.

In accordance with another aspect, a method of constructing a liquefied gas storage tank on land includes: producing unit-wall structures each having iron rods arranged lengthwise and breadthwise therein, each of the iron rods having distal ends exposed from surfaces of the unit-wall structure; stacking the produced unit-wall structures to be separated from each other while preventing the distal ends of the iron rods from interfering with each other; and connecting the iron rods of unit-wall structures adjacent in vertical and lateral directions to each other.

In accordance with a further aspect, a method of constructing a liquefied gas storage tank on land includes: producing unit-wall structures, each having iron rods arranged lengthwise and breadthwise therein; stacking the produced unit-wall structures to be separated from each other; and casting concrete in a space between the unit-wall structures to integrate the unit-wall structures with each other.

DETAILED DESCRIPTION

Embodiments of the present disclosure will now be described in detail with reference to the accompanying drawings in FIGS. 2-5.

Figure 2:
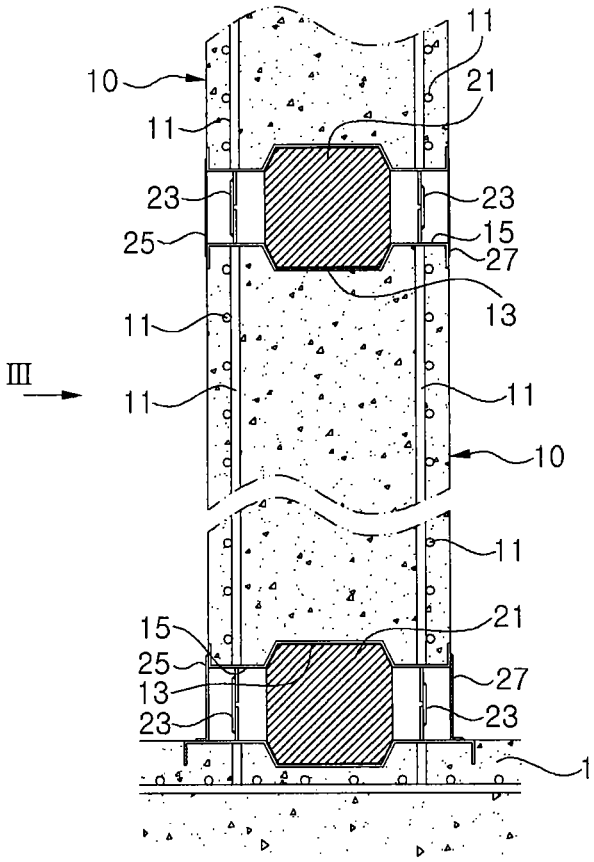
FIG. 2 is a cross-sectional view of a unit-wall structure for a liquefied gas storage tank in accordance with one embodiment of the present disclosure.
Figure 3:
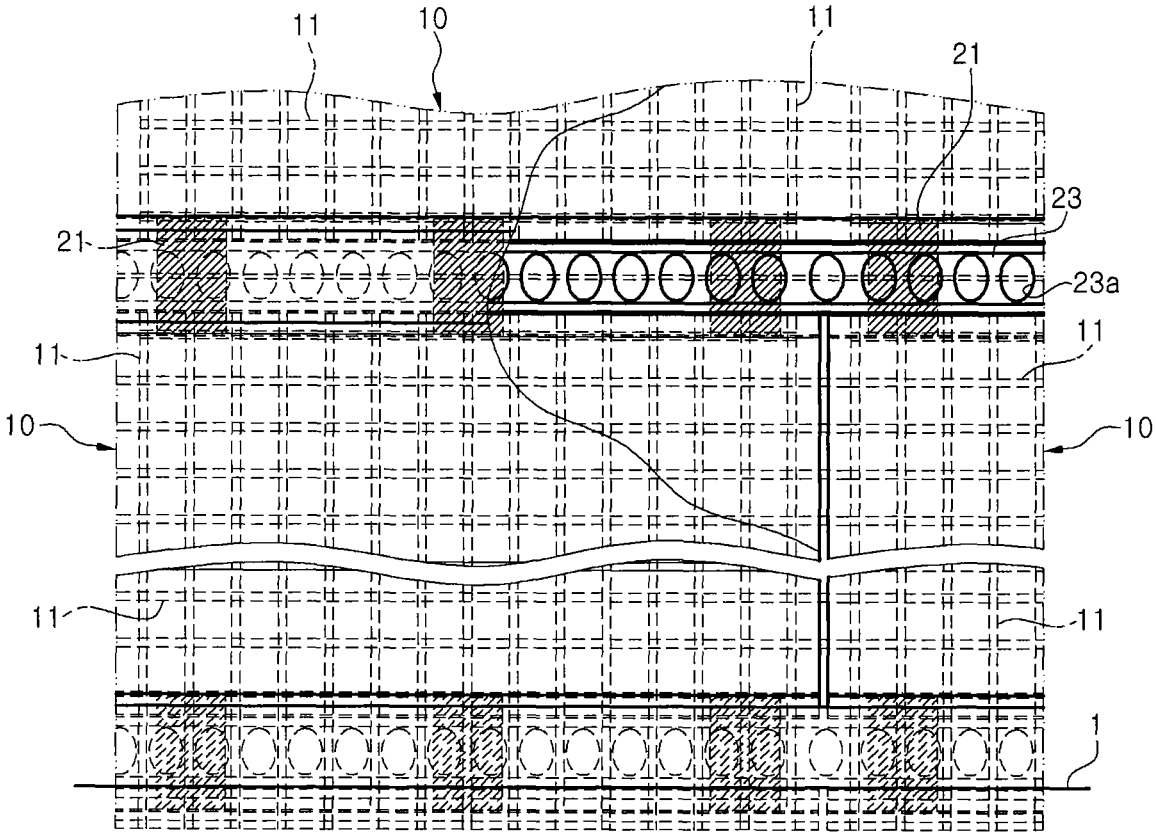
FIG. 3 shows a part of a wall of the liquefied gas storage tank of FIG. 2, viewed from the position of arrow III in FIG. 2, and having the unit-wall structures stacked to with respect to each other in accordance with one embodiment of the present disclosure.
Figure 4:
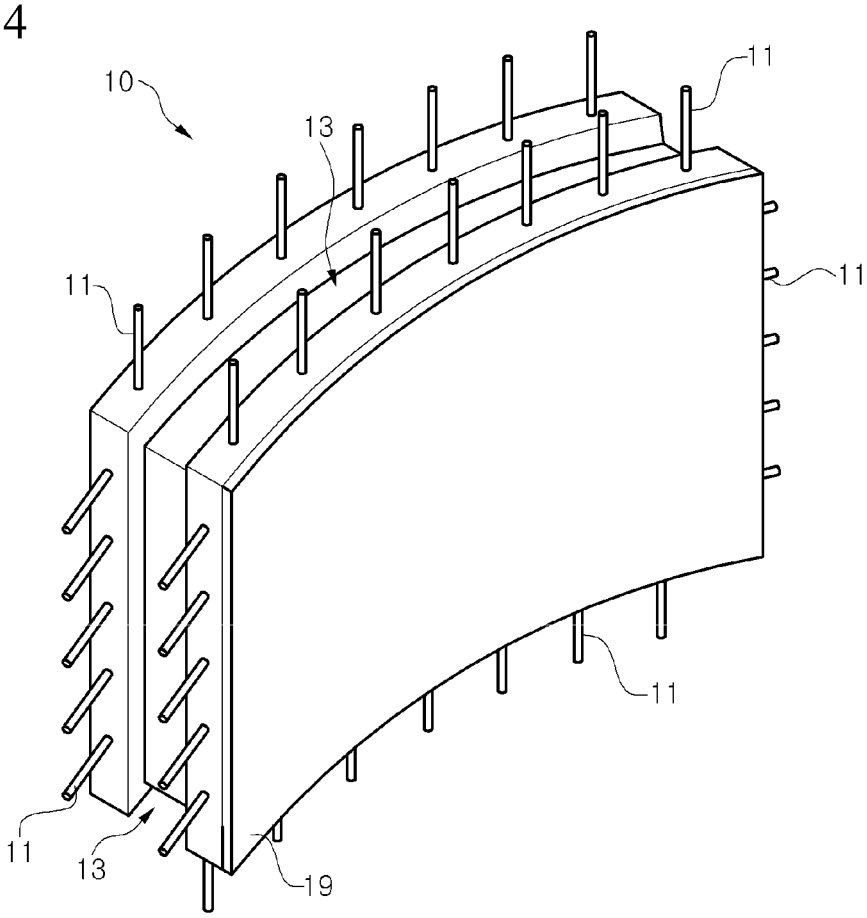
FIG. 4 is a perspective view of a unit-wall structure for the liquefied gas storage tank in accordance with one embodiment of the present disclosure.

Referring to FIGS. 2 to 4, a liquefied gas storage tank on land in accordance with one embodiment is constructed by stacking a plurality of unit-wall structures 10 in an approximately cylindrical arrangement on a foundation or base 1. Each of the unit-wall structures 10 is made of concrete and has a parallelepiped shape wherein iron rods 11 are arranged lengthwise and breadthwise.

Since the storage tank has a cylindrical wall formed by stacking the unit-wall structures 10, each of the unit-wall structures 10 may be rounded to have a substantially arc shape as shown in FIG. 4. Here, since the storage tank has a much greater radius than the width of each of the unit-wall structures, the unit-wall structure will be described as having a substantially parallelepiped shape hereinafter.

Each of the unit-wall structures 10 has grooves 13 on upper, lower, left and right surfaces thereof so that a positioning block 21 is disposed on each of the grooves 13 to stack the unit-wall structures 10 in place. The positioning blocks 21 allow each of the unit-wall structures 10 to be accurately located in place when the unit-wall structures 10 are stacked. Similar to the positioning block 21, a block (not shown) may be interposed between the unit-wall structures 10 adjacent to each other in a lateral direction to align the adjacent unit-wall structures 10 with each other.

In each of the unit-wall structures 10, two sets of iron rods 10 are arranged lengthwise and breadthwise, such that one set of iron rods 10 is assigned to the front side (left side in FIG. 2) of the unit-wall structure 10 and the other set is assigned to the rear side thereof. Distal ends of the iron rods 11 protrude from upper, lower, left and right surfaces of the unit-wall structure 10.

Thus, the distal ends of the iron cores 11 may protrude from the upper, lower, left and right surfaces of the unit-wall structure 10 to be arranged in two rows, as shown in FIG. 4. In one embodiment, referring to FIGS. 2 and 4, the iron rods 11 protruding from the upper and lower surfaces of the unit-wall structure 10 in the vertical direction may be further biased toward the front side or the rear side of the unit-wall structure 10 than the grooves 13 on which the positioning blocks 21 will be disposed.

The protruded iron rods of the adjacent unit-wall structures may be connected to one another by iron rod connecting plates 23, so that the adjacent unit-wall structures are secured to each other. To connect the iron rods to each other through the iron rod connecting plates 23, for example, welding may be performed. Alternatively, bolts, clamps or other fasteners may be used.

When stacking the pre-produced unit-wall structures at field sites, it is important to consider continuity (that is, prevention of stress concentration) and constructability (that is, method of connecting the iron rods of the respective unit-wall structures to each other) of the iron rods. In the embodiment, the exposed iron rods of the adjacent unit-wall structures are connected to each other by the iron rod connecting plates 23, thereby satisfying both continuity and constructability of the iron rods.

The iron rod connecting plate 23 may be configured to allow one iron plate to connect the iron rods 11 which are exposed from the unit-wall structures 10 adjacent to each other in the vertical or lateral direction. Alternatively, the iron rod connecting plate 23 may be configured to allow a pair of iron plates, which are attached to each other and joined to other adjacent iron plates by line-welding, to connect only the iron rods 11 to each other at one side of the unit-wall structure.

In one embodiment, when the unit-wall structures 10 are stacked with the positioning block 21 interposed therebetween, the height of the positioning block 21 is selected so as to prevent the distal ends of the iron rods 11 protruding from the surfaces of the unit-wall structures 10 adjacent to each other in the vertical direction from interfering with each other. For example, the height of the positioning block 21 is designed such that the ends of iron rods 11 of adjacent unit-wall structures 10 are spaced from each other by a small, selected distance.

Figure 5:
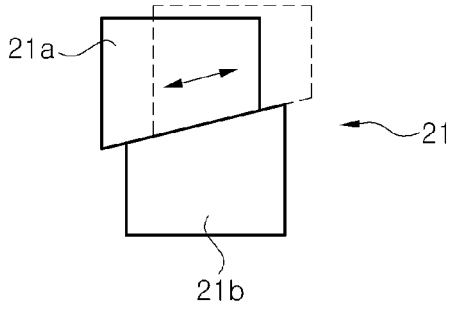
FIG. 5 is a side view of a height-adjustable positioning block in accordance with one embodiment.

In order to correct any possible error at a construction site, the positioning block 21 may be divided into upper and lower blocks 21*a* and 21*b* with a slanted plane provided as a border therebetween, as shown in FIG. 5 in one alternative embodiment. If the unit-wall structures 10 are stacked in actual construction to a height less than a design height, the upper block 21*a* is slightly moved downward (to the left side in FIG. 5) along the slanted plane as indicated by a solid line in FIG. 5 to lower the height of the positioning block 21. On the contrary, if the unit-wall structures 10 are stacked in actual construction to a height greater than the design height, the upper block 21*a* is slightly moved upward (to the right side in FIG. 5) along the slanted plane as indicated by a dotted line in FIG. 5 to increase the height of the positioning block 21.

In an embodiment that includes a multiple piece positioning block 21, other components may be included to control the movement of each block piece with respect to other block pieces. For example, fasteners, shims, or other structure, mechanism, or feature, can be incorporated to adjust and control exact height, position and movement of the block pieces of the embodiment of FIG. 5.

After the adjacent unit-wall structures 10 are connected to each other by the iron rod connecting plates 23, concrete may be cast into a space between the unit-wall structures 10 to prevent the iron rods 11 and the iron rod connecting plates 11 from being exposed. With this configuration, all of the unit-wall structures can be connected to each other to construct the cylindrical wall of the storage tank.

The plate 23 can be a size that, based on the height of block 21, will connect to the free ends of respective rods 11 from two different structures 10. The block 21 is a single solid block having predetermined height that is selected based on the length of the rods 11, the depths of groove 13 and the other factors to place the unit structures 10 the correct, exact distance from each other.

Blocks 21 of different heights can be obtained at a much lower cast than other changes in the wall, therefore if the groove is made a different depth or the length that rods 11 extend from the unit structure 10 varies, blocks 21 of a different height can be obtained to still continue with the proper spacing of between the unit structures 10.

Figure 1:
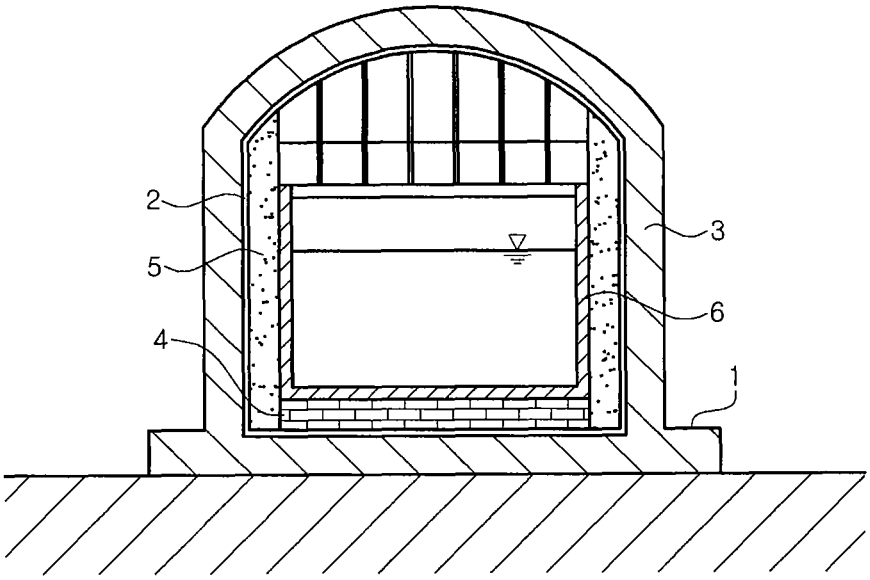
Prior Art Fig. 1
FIG. 1 shows a conventional full-containment type liquefied gas storage tank on land according to one embodiment.

As shown in FIG. 1, a front side connecting plate 25 and a rear side connecting plate 27 may be provided to front and rear sides of the adjacent unit-wall structures 10 to connect the adjacent front sides to each other and connect the adjacent rear sides to each other, respectively, while serving as moulds for casting concrete.

In order to facilitate installation of the front and rear side connecting plates 25, 27 by welding, the upper, lower, left and right surfaces of the unit-wall structures 10 may be surrounded by a metal frame 15.

In one aspect, the iron rod connecting plate 23 may be formed with a plurality of through-holes 23*a* through which the concrete can be easily cast into the iron rod connecting plate 23.

The iron rod connecting plate 23, the front side connecting plate 25, and the rear side connecting plate 27 can be used not only for connecting the unit-wall structures adjacent to each other in the vertical direction but also for connecting the unit-wall structures adjacent to each other in the lateral direction.

As such, according to one embodiment, all of the unit-wall structures 10 may be integrated to construct the integral cylindrical wall of the storage tank while ensuring sufficient strength by casting the concrete in the space between the adjacent unit-wall structures 10 while connecting the adjacent unit-wall structures to one another in the vertical and lateral directions using the iron rod connecting plate 23, the front side connecting plate 25, and the rear side connecting plate 27.

In one aspect, as shown in FIG. 4, a sealing layer 19, that is, a gas sealing wall acting as a gas barrier, may be attached to the rear side of the unit-wall structure 10, that is, an interior surface of the storage tank, to shield against gas leakage. By producing the unit-wall structures with the sealing layers 19 attached thereto, the wall of the storage tank can be advantageously constructed by stacking the unit-wall structures 10 in a cylindrical arrangement and connecting them to one another without separately stacking the sealing layers after constructing the wall of the storage tank. In some embodiments, the sealing layer 19 of at least some of the unit-wall structures 10 may extend beyond the boundaries of the interior surface thereof to overlap with the sealing layer 19 of adjacent unit-wall structures 10.

Next, a method of constructing a liquefied gas storage tank on land in accordance with one embodiment will be described with reference to FIGS. 2 to 4.

In this embodiment, the method may include producing unit-wall structures 10 using concrete, stacking the unit-wall structures 10 in a cylindrical arrangement, and connecting the adjacent unit-wall structures 10 to one another. The unit-wall structures 10 can each be formed in a generally parallelepiped shape with a curvature, which upon assembly of the unit-wall structures 10 forms a substantially cylindrical storage tank. The radius of curvature of unit structures 10 will determine the overall diameter of the completed tank.

As described above, each of the unit-wall structures 10 may be produced by casting concrete into a mould with iron rods 11 arranged lengthwise and breadthwise. Here, the unit-wall structure 10 may have grooves 13 on upper, lower, left and right surfaces thereof, and may be provided with a sealing layer 19 at one side thereof, that is, an inner surface of the completed storage tank.

When stacking the unit-wall structures 10 in the cylindrical arrangement, one or more positioning blocks 21 are disposed on the grooves 13, which are formed on the upper and lower surfaces of the unit-wall structure 10, to be interposed between the unit-wall structures 10 adjacent to each other in the vertical direction. With this configuration, positioning of the unit-wall structures 10 may be securely and conveniently achieved.

Then, exposed iron rods 11 of each unit-wall structure 10 are connected to those of other unit-wall structures 10 adjacent thereto in the vertical and lateral directions through iron rod connecting plates 23. In one aspect, the iron rods 11 and the iron rod connecting plates 23 may be integrally joined by welding or the like.

Further, adjacent front sides of the stacked unit-wall structures 10 are connected to each other by front side connecting plates 25, and adjacent rear sides of the stacked unit-wall structures 10 are connected to each other by rear side connecting plates 27.

Then, concrete is cast into a space between the unit-wall structures 10 adjacent to one another in the vertical and lateral directions, so that the stacked unit-wall structures 10 are completely connected and integrated.

On the other hand, foundation work may be performed on the ground to form a flat foundation before stacking the unit-wall structures 10 in the cylindrical arrangement. In one aspect, after stacking and connecting the unit-wall structures 10 to one another, operation of installing a cover is performed to complete a tank body of the storage tank, and a heat insulating wall and a sealing wall are disposed inside the tank body, thereby completing the liquefied gas storage tank.

In embodiments that include the sealing layer 19, when the sealing layer 19 is attached to the unit-wall structure 10 as shown in FIG. 4, the sealing wall may be formed while connecting the stacked unit-wall structures 10 without a separate operation of installing the sealing wall after completing the tank body.

In one embodiment, the pre-produced unit-wall structures made of concrete are stacked and concrete is then cast into spaces between the unit-wall structures at a construction site, thereby constructing the wall of the storage tank. As a result, the respective unit-wall structures can be more strongly integrated with one another using concrete as a binder of the unit-wall structures while reducing time consumed for construction of the storage tank.

A method according to embodiments of the present disclosure enables rapid and easy construction of a cylindrical wall of a liquefied gas storage tank by stacking a plurality of pre-produced unit-wall structures to be stacked or superposed with respect to one another, enabling a considerable reduction in time for construction of the liquefied gas storage tank on land, and reducing construction costs.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary, to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of constructing a liquefied gas storage tank on land, comprising:

stacking a plurality of unit-wall structures made of concrete and each having a front set and a rear set of iron rods arranged lengthwise and breadthwise therein, in a cylindrical arrangement, each of the unit-wall structures having respective grooves on upper and lower surfaces thereof, the stacking the plurality of unit-wall structures including interposing a positioning block between adjacent unit-wall structures within a corresponding set of the grooves on the adjacent unit-wall structures to ensure that the unit-wall structures are located in a desired position with respect to each other when the unit-wall structures are stacked, the positioning block located between protruded ends of the lengthwise iron rods of the front set and the rear set of iron rods of the adjacent unit-wall structures with a front side of the positioning block spaced inwardly from the protruded ends of the lengthwise iron rods of the front set of iron rods and a rear side of the positioning block spaced inwardly from the protruded ends of the lengthwise iron rods of the rear set of iron rods; and connecting the unit-wall structures that are adjacent to each other in longitudinal and lateral directions with respect to each other to form a wall of the storage tank.

2. The method according to claim 1 wherein each of the unit-wall structures further has respective grooves on left and right surfaces thereof.

3. The method according to claim 1 wherein the lengthwise iron rods protrude from opposing terminal longitudinal surfaces of each unit-wall structure, the breadthwise iron rods protrude from opposing terminal lateral surfaces of each unit-wall structure, and the connecting the unit-wall structures includes connecting the protruded iron rods of each of the unit-wall structures to the protruded iron rods of other unit-wall structures adjacent thereto in the longitudinal and lateral directions.

4. The method according to claim 3 wherein the iron rods are connected to each other through an iron rod plate having a plurality of through-holes.

5. The method according to claim 3 wherein the connecting the unit-wall structures includes connecting front sides of the unit-wall structures to each other and connecting rear sides of the unit-wall structures to each other, after connecting the iron rods to the iron rods of adjacent unit-wall structures.

6. The method according to claim 5 wherein the front sides of the unit-wall structures are connected to each other through a front side connecting plate and the rear sides of the unit-wall structures are connected to each other through a rear side connecting plate.

7. The method according to claim 3, further comprising:

casting concrete into a space between the unit-wall structures to integrate the unit-wall structures with each other after connecting the iron rods to the iron rods of adjacent unit-wall structures.

8. The method according to claim 1 wherein each of the unit-wall structures is provided at one side thereof with a sealing layer, and the connecting the unit-wall structures includes connecting the sealing layers of the respective unit-wall structures to each other.

9. The method according to claim 1, further comprising:

performing foundation work to form a foundation before stacking the unit-wall structures; and placing a cover to complete a tank body of the storage tank after connecting the unit-wall structures.

10. A method of constructing a storage tank, the method comprising:

stacking a plurality of unit-wall structures each having a front set and a rear set of connecting rods arranged lengthwise and breadthwise therein and each having respective grooves on an upper mating surface and a lower surface thereof;

interposing a positioning block between adjacent unit-wall structures within a corresponding set of the grooves of the adjacent unit-wall structures while stacking the adjacent unit-wall structures with a front side of the positioning block spaced inwardly from protruded ends of the lengthwise connecting rods of the front set of connecting rods of the adjacent unit-wall structures and a rear side of the positioning block spaced inwardly from protruded ends of the lengthwise connecting rods of the rear set of connecting rods of the adjacent unit-wall structures; and connecting the unit-wall structures that are adjacent to each other in longitudinal and lateral directions with respect to each other to form a wall of the storage tank.

* * * * *